United States Patent [19]

Whitman

[11] Patent Number: 4,860,513

[45] Date of Patent: Aug. 29, 1989

[54] ROOFING FASTENER

[76] Inventor: Robert E. Whitman, 1-2143 Sherwood La., Swanton, Ohio 43558

[21] Appl. No.: 147,810

[22] Filed: Jan. 25, 1988

[51] Int. Cl.[4] ..... E04D 13/16

[52] U.S. Cl. ..... 52/410; 411/369; 411/542

[58] Field of Search ..... 411/82, 368, 369, 380, 411/381, 533, 537, 542, 538; 52/408–410, 309.2, 309.8, 309.9, 94, 199, 506, 512

[56] References Cited

U.S. PATENT DOCUMENTS

| | | | |
|---|---|---|---|
| 1,498,019 | 6/1924 | Dodds | 411/380 X |
| 2,470,927 | 5/1949 | Hale, Jr. | 411/533 X |
| 2,770,161 | 11/1956 | Schutte | 411/533 |
| 3,491,630 | 1/1970 | Mielke | 411/368 |
| 4,476,660 | 10/1984 | Francovitch | 52/515 |
| 4,606,168 | 8/1986 | Fuhrer | 52/741 |
| 4,625,469 | 12/1986 | Gentry et al. | 52/3 |
| 4,712,957 | 12/1987 | Edwards et al. | 411/82 |

FOREIGN PATENT DOCUMENTS

| | | | |
|---|---|---|---|
| 3608775 | 9/1987 | Fed. Rep. of Germany | 411/82 |
| 11403 | of 1901 | United Kingdom | 52/512 |
| 892870 | 4/1962 | United Kingdom | 411/369 |

*Primary Examiner*—James L. Ridgill, Jr.

*Attorney, Agent, or Firm*—George R. Royer

[57] ABSTRACT

The invention herein is a roofing fastener with integrated swivel means on the upper part to facilitate the process of affixing rectangularly shaped sheets of rubber roofing material to the upper surface of a roof. Specifically, the invention is a longitudinally disposed fastening member in the general form of a screw or nail-like member which is adapted to be inserted through the upper surface of the rubber roofing sheets and thence through the upper surface of the roof structure, serving thereby to anchor the rubber roofing sheets to the fixed roof structure. The fastening device may optionally have a longitudinally extending centrally located chamber which is co-axially aligned with the longitudinal central axis of the fastening member, and this chamber has a plurality of laterally disposed openings which extend from the chamber to the outer surface of the fastening member, said chamber being adapted to receive a liquid sealant at an opening in the upper surface and disperse same through such lateral openings. On the upper portion of the longitudinally disposed fastening member is a circular cap member which is eccentrically disposed about a semispherical configuration on the lower part of the head member, so that the cap member can swivel about such head.

3 Claims, 1 Drawing Sheet

ROOFING FASTENER

BACKGROUND OF INVENTION AND DESCRIPTION OF PRIOR ART

The subject invention is a fastening device for aiding in the process of securing sheets of rubber roofing to the upper surface of a roof. In this regard, roofing sheets made of rubber material are now used more widely for roof coverings because of the durability factor.

The general approach is to place over the upper roof surface rubber roof sheets so that they encompass the entire upper roof surface as a complete and secure roof covering. In many applications, strategically placed bonding plates are affixed over the top of the rubber roof sheets to secure the rubber roof sheets in a flush manner to the upper roof surface. A usual arrangement in using such fastening or bonding plates is a series of evenly-spaced rows and columns of such plates, regularly and symmetrically spaced as seen from an upper elevational view. Bonding plates function to securely hold the rubber roofing sheets in place with the aid of a fastening device such as a longitudinally extending screw-like or nail-like member forcibly thrust downwardly through the horizontally disposed bonding plate through the rubber roofing material, and into the roof deck or fixed roof structure. Thus, the present practice, as stated, is to affix the bonding plates over the upper roof surface, using nails or screws in order to firmly adhere the bonding plate firmly against the upper surface of the roofing sheets.

One of the predominant problems encountered with the use of nails or screws in fastening such bonding plates is that when they are inserted into the roof deck, they generally cause distortion damage in the wood or other roof material immediately around the screw or nail. Such distortion damage usually leaves gaps or spaces adjacent the screw or nails. This, in turn, causes weakness in the roof structure and also yields a potential source of roof leaks through the nail openings. Yet another problem that is encountered in this regard is that at times when the nail or screw-like member is lodged through the roof structure at an angle from the vertical, the hole in the roof becomes uneven and the top plate does not rest securely and flush against the roof surface. As a result, air and water may penetrate through the roof at this juncture. This invention is therefore directed to overcome these problems and the following objects are directed accordingly.

OBJECTS

In view of the above, it is an object of the subject invention to provide an improved device for affixing rubber roofing sheets to the upper surface of a roof;

Still another object of the subject invention is to provide an improved fastening device for installing rubber roof sheets for covering roof structures;

A further object of the subject invention is to provide an improved sealing and securing apparatus for affixing roofing materials to a roof structure;

Yet another object of the subject invention is to provide an improved swivel fastening device;

Still another object of the subject invention is to provide an improved device for adhering and affixing rubber roof sheets to the upper surface of a roof;

Other and further objects will become apparent from a reading of the following description taken in conjunction with the claims.

DESCRIPTION OF GENERAL EMBODIMENT

The invention herein is a roofing fastener with integrated swivel means on the upper part to facilitate the process of affixing rectangularly shaped sheets of rubber roofing material to the upper surface of a roof. Specifically, the invention is a longitudinally disposed fastening member in the general form of a screw or nail-like member which is adapted to be inserted through the upper surface of the rubber roofing sheets and thence through the upper surface of the roof structure, serving thereby to anchor the rubber roofing sheets to the fixed roof structure. The fastening device may optionally have a longitudinally extending centrally located chamber which is coaxially aligned with the longitudinal central axis of the fastening member, and this chamber has a plurality of laterally disposed openings which extend from the chamber to the outer surface of the fastening member, said chamber being adapted to receive a liquid sealant at an opening in the upper surface and disperse same through such lateral openings. On the upper portion of the longitudinally disposed fastening member is a circular cap member which is eccentrically disposed about a semispherical configuration on the lower part of the head member, so that the cap member can swivel about such head.

DESCRIPTION OF PREFERRED EMBODIMENT

The subject invention centers on a device used for affixing rubber roof sheets to the upper surface of a roof of any type of building structure. Moreover, the preferred embodiment of the subject invention is most applicable to roof structures wherein the roof is horizontal, although it is not to be so limited. While the description below is explicitly directed to an application wherein the fastening or bonding plates are affixed over top of the rubber roof sheets, it will be understood that this invention is equally applicable to those circumstances wherein the bonding plataes are affixed between the upper roof surface and the lower surface of the rubber roofing sheets. Moreover, description and application of the preferred embodiment is not to be considered as limiting the scope of the subject invention.

Figure 2:
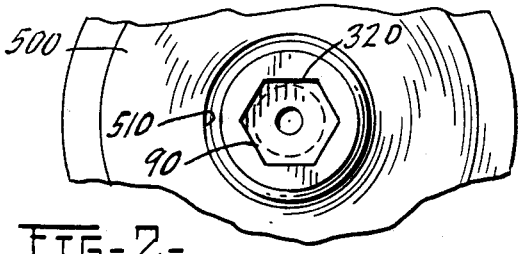
FIG. 2 is a top elevational view of an alternate embodiment of the subject device.
Figure 1:
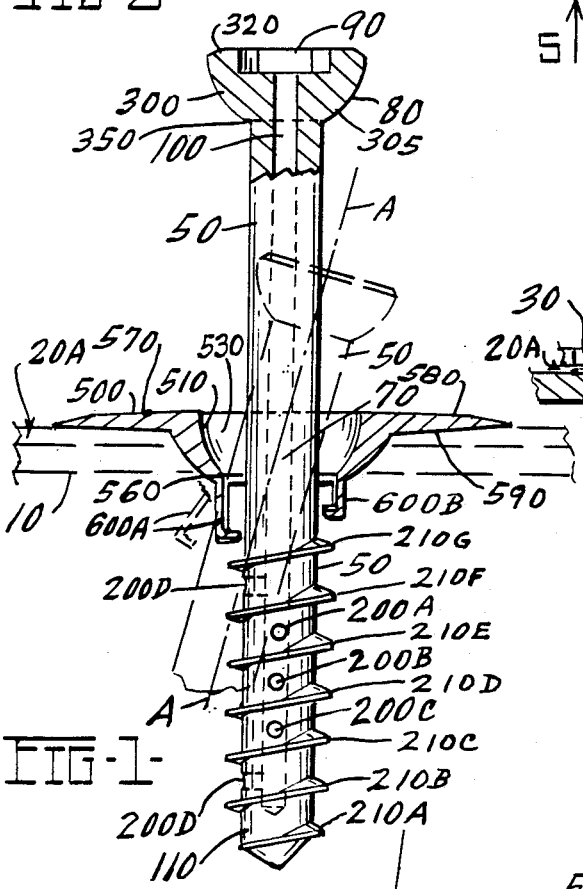
FIG. 1 is a side elevational view in section of the device utilizing the invention herein.

Turning now to the drawing, the subject invention involves a device and method to aid in the affixing of rubber roof sheets to a roof surface such as roof 10 shown in FIG. 1. In this respect, the roof 10 is shown as a horizontal, flat roof having perimeter edges not shown. Such roof 10 is considered conventional in this regard, however, the subject invention can apply to a roof of any external configuration, whether rectangular, flat, or other structural shape.

Figure 5:
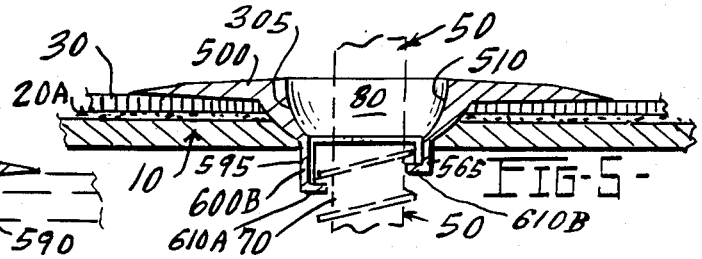
FIG. 5 is a side elevational view of the subject invention, in cross section.

In the process of affixing rubber roof sheets to roof 10, the first step in the process is to lay, in a flush manner, a plurality of rectangular shaped rubber roof sheets, such as sheet 20A, shown in FIGS. 1 and 5, to the upper surface of the roof 10. The rubber sheet 20A is affixed over the upper surface of the roof along with the other rubber sheets so that all such sheets cover the entire roof surface in a flush manner. Next, a bonding plate such as bonding plate 30 may be affixed over the upper surface of the rubber roof sheet 20A, as shown in FIG. 5 once the rubber roof sheet 20A is laid in the manner described above. Such bonding plates 30 are generally affixed in a series of evenly-spaced rows and columns, in a similar grid pattern over the upper roof surface, although this feature is not critical to the subject invention and the subject invention may be affixed or applied without the aid or use of bonding plates as shown in the application shown in FIG. 1. The subsequent step is to nail, screw, spike or affix by a suitable fastening member the rubber roofing sheet 20A to the roof 10, either through a bonding plate or without a bonding plate as an intermediate member. Thus, as discussed above, a horizontal bonding plate can be used as an intermediate securing member with the fastening device inserted through a vertical opening in such bonding plate. In the embodiment shown in the drawings and described herein, except for that shown in FIG. 5, no such intermediate bonding plate is used.

Certain applications are better suited for screws as opposed to nails as such fastening devices on other means as the fastening device to secure the rubber roof to the roof. In this latter regard, irrespective of whether the fastening member is a nail, spike, screw, or other similar longitudinally extending member, it extends vertically downward through the rubber roof sheet 20A and roof 10, as shown.

Figure 3:
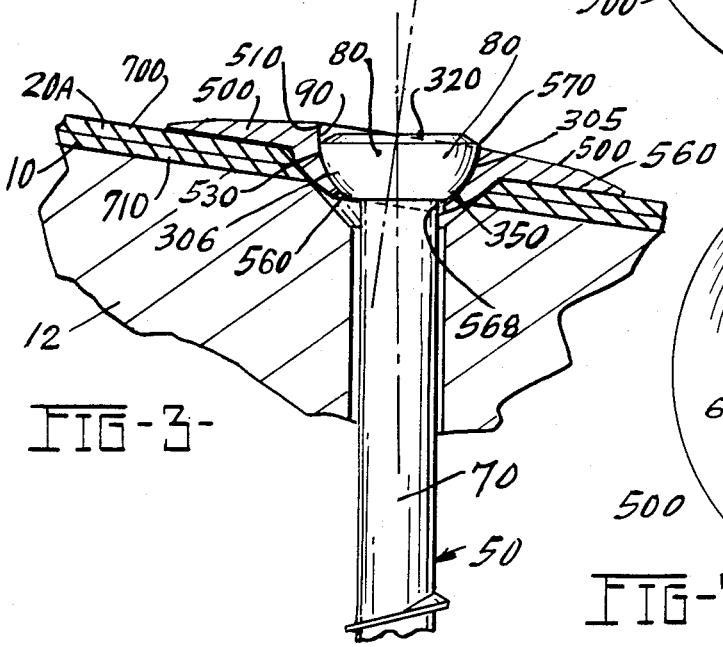
FIG. 3 is a side elevational view in cross section of the device shown as inserted in a roof.

For purposes of describing the preferred embodiment of the subject invention, it is to be noted at this juncture that the description herein will be directed to screw-like fastening device 50, shown in FIGS. 1 and 3. However, it is to be stressed that the features of the subject invention are equally applicable to a nail like or other type of fastening device, not shown, or any other such similar longitudinally-extending fastening device.

As seen in FIGS. 1 and 3, the roof fastening member 50 is a longitudinally extending member having a vertical shank 70 extending vertically downwardly from a round, enlarged head 80. As can be seen, the round head 80 is larger than the usual nail head for the reason that it is desirable to prevent water leakage around the area of the head 80.

In the upper surface of the head 80 is an opening 90, which opening extends vertically downwardly from the upper surface of the head 80 communicating and extending directly to a central vertical chamber 100 that extends downwardly through the center of the shank 70 of the fastening member, as shown. The vertical chamber 100 is longitudinally extending such that is coaxially aligned with the longitudinal central axis of the shank 70. As such, the longitudinal chamber 100 is completely within the shank 70 portion and such chamber 100 ends just short of the bottom 110 of the shank 70.

As shown, such vertically disposed chamber has a plurality of laterally disposed openings 200A . . . 200Z which openings are adapted to vent any substance such as a liquid adhesive or glue, which is inserted into the opening 90 in head 80 so as to flow downwardly through the central chamber 100 to areas outside the vertical shank 70 and into roof structure 10. This latter feature, thus enables any liquid adhesive poured into the top of the vertical chamber 100 to be vented laterally to areas outside the shank 70 and thus outside the fastening device 50 into the surrounding roof structure 10 and additionally into substructure below the roof 10. This is consummated in order to securely seat the fastening device 50 into the surrounding roof structure 10, and substructure 12.

As can be seen from the drawings, the outside lower surface of the vertical shank 70 has threaded protrusions 210A, 210B . . . 210G thereon which threaded protrusions serve to seat the threaded shank 70 into the roof structure 10 and any substructure thereunder. As stated, use of such a threaded surface on the exterior of shank 70 is an optional feature in the constructional and deployment of the subject device.

Figure 4:
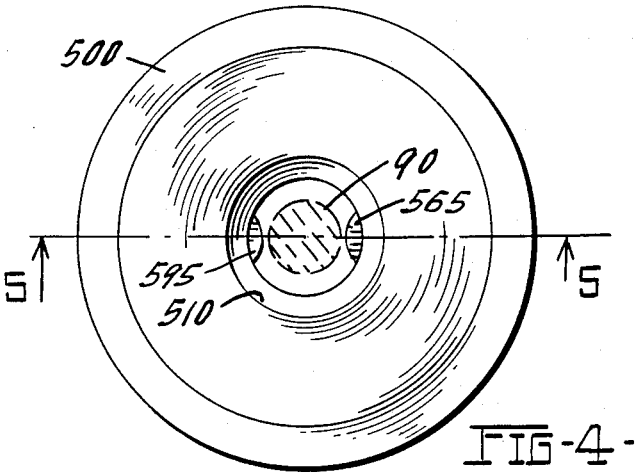
FIG. 4 is a top elevational view of the subject device.
Figure 6:
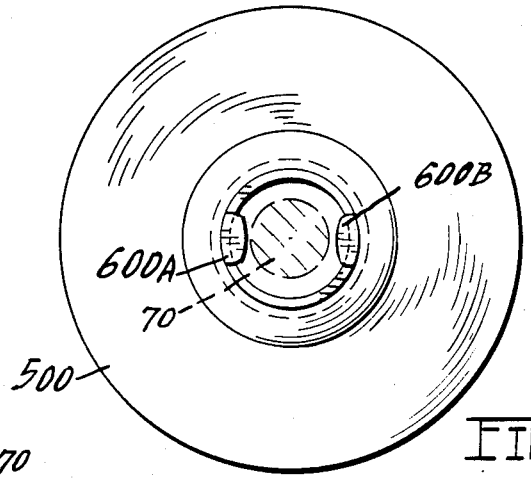
FIG. 6 is a top elevational view of the top securing plate.
Figure 7:
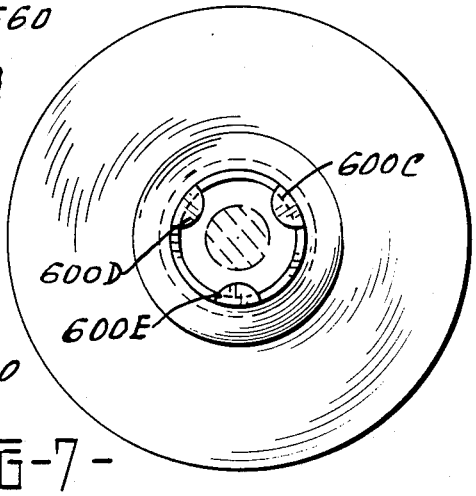
FIG. 7 is a bottom elevational view of the top securing plate.

As can be seen from the side elevational view of FIGS. 1 and 3, the upper enlarged lead 80 on the upper part of vertical shank 70 has a semispherical surface 300 on the bottom portion 305 portion of the head, while the upper surface 320 of the head is flat across its total surface, with the exception of the opening 90 as shown in the drawings. Alternately stated, the lower portion 305 of the head 80 is rounded in a substantially semispherical manner, such hemispherical configuration basically extending from the upper flat surface 320 of the head 80 to the upper extreme vertical extent 350 of the shank 70, as shown in FIGS. 1 and 3. The degree of sphericality of the lower portion 305 of the head 80 may vary from application to application without exceeding the scope of the subject invention, so long as such lower head portion 305 is rounded to some degree. As can be seen in the drawings, the rounded portion of the lower part 305 of head 90 merges distinctly with the vertical part of shank The fastening member 50 is adapted and constructed to be inserted into a disc-like shield 500 is shown in FIGS. 1 and 3. The shield 500 is preferably circular in shape as viewed from a top or bottom elevational view, as seen in FIGS. 4, 6 and 7. This latter configuration is not critical to the subject invention however, as the shield may be of any configuration.

As can be seen in the drawings, the disc 500 has a centrally disposed opening 510 which leads to a semispherically shaped depression 530 extending downwardly from the opening 510. Alternately stated, and as can be seen from the drawings, the depression 510 in shield 500 is rounded in a spherical manner with the upper part of the opening being larger than the lower part, with the diameter of the opening gradually decreasing, as can be particularly observed in FIG. 1. By such constructional arrangement, the inner surface of such opening is semispherical to the point where there is a circular opening 560 in the bottom of the depression 530, which latter opening communicates between the inner space of the depression 530 and areas outside and below the circular disc 500. The diameter of opening 560 is just sufficiently large enough to receive therethrough, in a longitudincal manner, the longitudinal shank 70 of the fastening member 50. This latter inserting relationship is shown in FIG. 1, in the initial stage of insertion, and in FIG. 3, which shows the shank 70 completely inserted to the maximum extent. At this latter extent, the enlarged head 80 of the fastening device 50 rests conformingly in the depression 530 in shield 500. Also, in this latter relationship the lower spherical surface 305 of the head 80 is adapted to move with a degree of freedom in an angular movement from the straight up and down vertical, as shown in FIG. 1, with the angular off-vertical position shown in phantom, along the axis A—A and shown in FIG. 1. For this latter purpose, the diameter of opening 564 in the bottom of depression 530 should be slightly larger than the diameter of the shank 70 of the fastening device 50 so as to permit a limited degree of movement or wobble, about the vertical of the shank 70 and head 305 within the depression 530, as graphically shown in FIG. 1. This permits the shank 70 to move about the vertical several degrees relative to the plane of disc member 500, thus permitting the fastening device 50 to be moved to such an off angle position while permitting the disc 500 to remain flat and flush against the upper roof surface. This facet thus accommodates those situations when the nail or screw-like fastening device is inadvertently driven in at an angle, and still protects the integrity of the opening thrust into the roof, protecting it thereby from moisture ingress and other related problems. Alternately stated, as can be observed from the drawings and particularly FIGS. 1 and 3, disc member 500 as viewed from a side elevational view is somewhat saucer-shaped with a depressed bowl portion 530 in the middle, and an enlarged rim portion 565 on the circumferential periphery. The middle bowl portion 530 has the semispherical depression 530 extending from the upper surface 580 of the disc member 500 to the bottom thereof and bottom opening 560, as shown. At the extreme bottom portion of the semispherical depression 530 is a bottom opening 560 of generally circular shape. This latter opening 560 extends completely from the depression 510 of disc 500 to the bottom surface 590 of the disc member 500. In the preferred embodiment of the subject invention, the lower part of shank 70 of fastening member 50 is inserted through the depression 510 downwardly through the bottom opening 560 until the semispherical bottom portion 300 of the head 80 of fastening device 50 rests in a rotatable position in the depression 510, as shown in FIG. 3. It is preferable that the bottom semispherical portion 300 of the head 80 not fit conformingly into the depression 530 for the reason that it is desired that the head 80 of the fastening device 50 be able to swivel appreciably in a pivotal manner in the depression 530, as to be movable in all radial directions such as the position shown in phantom in FIG. 1. This, in turn, accommodates the shank 70 of fastening member 50 moving away from the precise vertical position as schematically demonstrated in FIG. 1. This feature is helpful in situations where the shank 70 becomes imperfectly aligned with the vertical, and thus by such swiveling feature permits the disc 500 to remain level on the roof upper surface so as to complete a secure fastening relationship with the disc bottom surface 590 remaining flush or level with the upper roof surface and thereby preventing roof leakage.

In summary, the subject invention is a device for fastening rubber roof sheeting to the upper surface of a roof deck comprising a longitudinally extending fastener member 50 with a longitudinally extending shank 70 adapted to pierce a roof structure 10 and its substructure 12 for fastening purposes, said longitudinally extending member 50 having an enlarged head member 80, such enlarged head member 80 having an upper portion and a lower portion, and wherein said lower portion 305 is rounded on its lower surface in a semispherical menner and wherein said shank 70 being adapted to fit into a semispherical depression 530 with a bottom opening 560 semispherical shape in a disc member 500 having such opening 530 extending therethrough so as to receive the longitudinally extending shank member 70 through such depressed opening 560 and wherein such opening is rounded to hold the bottom of semispherical portion 305 of the head 80 of the fastening member 50. Alternately stated, the subject invention is a device for fastening roof covering to the upper surface of a roof deck for a building comprising a longitudinally extending fastening member having a first end and a second end with a longitudinally extending shank, said shank adapted to pierce a roof deck for fastening the roof covering to said roof deck, said longitudinally extending fastening member having an enlarged head member on the first end, said enlarged head member having an upper portion and a lower portion, and wherein said lower portion is rounded on its lower surface in a semispherical manner with disc means having an upper surface and a lower surface, with an opening and depression extending completely from the upper surface to the lower surface of said disc to receive the longitudinally extending shank member through such opening and wherein said opening and depression is rounded in a semispherical manner to hold the bottom semispherical portion of the said enlarged head of the fastening member in a partially movable manner. In an alternate arrangement for the subject device, the bottom surface 590 of the disc 500 is provided with a circular receptacle 565 disposed concentrically around the bottom opening 564 on lower surface 590. This receptacle 565 has opposing portions 600A and 600B, as seen in FIG. 1, and these opposing portions 600A and 600B are of different heights so as to grasp different portions of the threaded members 210A . . . 210G so as to lock the threaded shank 70 against being pulled upward and out of the shield 500.

While a preferred embodiment of the subject invention has been described, it shall not be construed as limiting the scope of the invention or claims.

I claim:

1. A device for fastening rubber roof sheeting to a roof deck having an upper surface:

(a) a longitudinally extending fastener member with a longitudinally extending shank member, adapted to pierce a roof structure for fastening purposes, said longitudinally extending shank member having an enlarged head member, said enlarged head member having an upper portion and a lower portion, and wherein said lower portion is rounded on its lower surface in a semispherical manner, with receptacle means on the upper portion of said head member to receive fluids, and with venting means for said fluid along extended portions of said longitudinally extended shank member;

(b) disc means having an opening and depression therethrough to receive the longitudinally extending shank member through such opening and wherein said opening is rounded in a semispherical manner to hold the bottom semispherical portion of the head of the fastening member, with the diameter of said opening and depression in the disc means being larger than the diameter of the enlarged head on the longitudinally extending shank member;

(c) circular receiptacle means disposed integrally on the bottom portion of said disc means, said circular receptacle means being concentrically disposed beneath the bottom portion of opening and depression in the disc means, with said circular receptacle having two opposing portions integrally disposed thereon, with such opposing portions being positioned at different vertical heights.

2. A device for fastening roof coverings to a roof deck having an upper surface for a building comprising:

(a) a longitudinally extending fastening member having a first end and a second end with a longitudinally extending shank, said shank adapted to pierce a roof deck for fastening the roof covering to said roof deck, said longitudinally extending fastening member having an enlarged head member on the first end, said enlarged head member having an upper portion and a lower portion, and wherein said lower portion is rounded on its lower surface in a semispherical manner;

(b) disc means having an upper surface and a lower surface, with an opening and depression extending completely from the upper surface to the lower surface of said disc means, said opening adapted to receive the longitudinally extending shank member through such opening and wherein said opening and depression is rounded in a semispherical manner to hold the bottom semispherical portion of said enlarged head of the fastening member in a partially movable manner;

(c) circular receptacle means disposed integrally on the bottom portion of said disc means, said circular receptacle means being concentrically disposed beneath the bottom portion of opening and depression in the disc means, with said circular receptacle having two opposing portions integrally disposed thereon, with such opposing portions being positioned at different vertical heights.

3. A device for fastening roof covering to the upper surface of a roof deck comprising:

(a) a longitudinally extending fastening member having a first end and a second end with a longitudinally extending shank, adapted to pierce a roof deck for fastening said covering to said deck, said longitudinally extending member having an enlarged head member, said enlarged head member having an upper portion and a lower portion, and wherein said lower portion is rounded on its lower surface in a semispherical manner;

(b) plate means having an upper surface and a lower surface with an opening extending therethrough from the upper surface to the lower surface to receive the second end of the longitudinally extending shank member through such opening and wherein said opening is rounded in a semispherical manner to hold the bottom semispherical portion of the head of the fastening member in a limited movable manner.

* * * * *